US009318063B2

(12) United States Patent
Kim

(10) Patent No.: US 9,318,063 B2
(45) Date of Patent: Apr. 19, 2016

(54) DISPLAY APPARATUS AND METHOD OF DRIVING THE SAME

(75) Inventor: Tae-Jin Kim, Yongin (KR)

(73) Assignee: SAMSUNG DISPLAY CO., LTD., Yongin, Gyunggi-Do (KR)

( * ) Notice: Subject to any disclaimer, the term of this patent is extended or adjusted under 35 U.S.C. 154(b) by 463 days.

(21) Appl. No.: 13/591,531

(22) Filed: Aug. 22, 2012

(65) Prior Publication Data

US 2013/0215096 A1 Aug. 22, 2013

(30) Foreign Application Priority Data

Feb. 17, 2012 (KR) ..... 10-2012-0016471

(51) Int. Cl.
*G09G 3/36* (2006.01)

(52) U.S. Cl.
CPC ..... *G09G 3/3648* (2013.01); *G09G 3/3655* (2013.01); *G09G 3/3614* (2013.01); *G09G 2320/0214* (2013.01); *G09G 2320/103* (2013.01); *G09G 2330/021* (2013.01)

(58) Field of Classification Search
CPC ..... G09G 3/3648; G09G 3/3655
USPC ..... 345/87–104, 204–699
See application file for complete search history.

(56) References Cited

U.S. PATENT DOCUMENTS

| | | | | |
|---|---|---|---|---|
| 7,542,021 | B2 * | 6/2009 | Kim et al. | 345/98 |
| 8,791,928 | B2 * | 7/2014 | Chen et al. | 345/204 |
| 2004/0104875 | A1 * | 6/2004 | Kim et al. | 345/87 |
| 2005/0088392 | A1 * | 4/2005 | Kim et al. | 345/94 |
| 2006/0145983 | A1 * | 7/2006 | Lee et al. | 345/92 |
| 2007/0024565 | A1 * | 2/2007 | Choi | 345/98 |
| 2007/0228411 | A1 * | 10/2007 | Lee et al. | 257/147 |
| 2007/0296682 | A1 * | 12/2007 | Hwang | 345/100 |
| 2008/0018579 | A1 * | 1/2008 | Choi et al. | 345/90 |
| 2008/0055292 | A1 * | 3/2008 | Do et al. | 345/204 |
| 2008/0062107 | A1 * | 3/2008 | Su et al. | 345/92 |
| 2008/0122826 | A1 * | 5/2008 | Tung et al. | 345/211 |
| 2008/0303763 | A1 * | 12/2008 | Lim | 345/87 |
| 2008/0303768 | A1 * | 12/2008 | Do et al. | 345/90 |
| 2009/0058776 | A1 * | 3/2009 | Tomohiro et al. | 345/87 |
| 2010/0001940 | A1 * | 1/2010 | Lee et al. | 345/90 |
| 2010/0201669 | A1 * | 8/2010 | Kim et al. | 345/211 |
| 2010/0214309 | A1 * | 8/2010 | Bae et al. | 345/589 |

(Continued)

FOREIGN PATENT DOCUMENTS

| | | | |
|---|---|---|---|
| KR | 10-2006-0124160 | A | 12/2006 |
| KR | 10-2006-0127504 | A | 12/2006 |

(Continued)

*Primary Examiner* — Kumar Patel
*Assistant Examiner* — Sejoon Ahn
(74) *Attorney, Agent, or Firm* — Lee & Morse, P.C.

(57) ABSTRACT

A method of driving a display apparatus including a plurality of pixels that respectively store a voltage level corresponding to a data signal and respectively include a storage capacitor connected between a pixel electrode and a second common voltage electrode, the method including operations of determining whether image data of a current frame is changed, compared to image data of a previous frame, when the image data of the current frame is changed, storing a voltage level corresponding to the image data of the current frame in the storage capacitor of each of the plurality of pixels, and when the image data of the current frame is not changed, changing a level of a second common voltage applied to the second common voltage electrode of each of the plurality of pixels.

16 Claims, 8 Drawing Sheets

(56) References Cited

U.S. PATENT DOCUMENTS

| | | | | |
|---|---|---|---|---|
| 2011/0102401 | A1* | 5/2011 | Feng | 345/211 |
| 2011/0157131 | A1* | 6/2011 | Miyake | 345/211 |
| 2011/0205254 | A1* | 8/2011 | Umezaki et al. | 345/690 |
| 2012/0091997 | A1* | 4/2012 | Huang | 324/123 R |
| 2012/0105407 | A1* | 5/2012 | Zhan | G09G 3/3614 345/209 |
| 2012/0120117 | A1* | 5/2012 | Hsieh et al. | 345/690 |
| 2012/0162184 | A1* | 6/2012 | Kim et al. | 345/212 |
| 2012/0206436 | A1* | 8/2012 | Nakata et al. | 345/212 |
| 2012/0319962 | A1* | 12/2012 | Yang et al. | 345/173 |
| 2013/0038621 | A1* | 2/2013 | Choi et al. | 345/589 |
| 2013/0215003 | A1* | 8/2013 | Do et al. | 345/92 |
| 2014/0313113 | A1* | 10/2014 | Jang | G09G 3/3614 345/87 |

FOREIGN PATENT DOCUMENTS

| | | | |
|---|---|---|---|
| KR | 10-2008-0040953 | A | 5/2008 |
| KR | 10-2008-0102748 | A | 11/2008 |
| KR | 10-2009-0059627 | A | 6/2009 |

* cited by examiner

DISPLAY APPARATUS AND METHOD OF DRIVING THE SAME

CROSS-REFERENCE TO RELATED PATENT APPLICATION

This application claims the benefit of Korean Patent Application No. 10-2012-0016471, filed on Feb. 17, 2012, in the Korean Intellectual Property Office, the disclosure of which is incorporated herein in its entirety by reference.

BACKGROUND

1. Field

Example embodiments relate to a display apparatus and a method of driving the display apparatus.

2. Description of the Related Art

A display apparatus includes a plurality of pixels, each having brightness corresponding to image data, so that the image data is displayed. The brightness of light emitted from each pixel is adjusted according to a level of voltage or an amplitude of current, which is applied to each pixel. A data signal corresponding to the image data is applied to each pixel, and in this regard, a considerable amount of power is consumed to generate and to drive the data signal.

Each pixel may include a storage capacitor to store a level of the data signal. The storage capacitor stores the level of the data signal in a period between the data signal and a next data signal. Except for the time at which a data signal is applied, the storage capacitor is blocked from a data line by a switching device, wherein the data line delivers the data signal. However, when a leakage current occurs via the switching device, charges stored in the storage capacitor may leak, such that an image quality may deteriorate.

SUMMARY

Example embodiments provide a display apparatus and a method of driving the display apparatus, whereby deterioration of image quality due to a leakage current from a storage capacitor may be prevented, and power consumption to drive a data signal may be decreased.

According to an aspect of the example embodiments, there is provided a method of driving a display apparatus including a plurality of pixels that respectively store a voltage level corresponding to a data signal and respectively include a storage capacitor connected between a pixel electrode and a second common voltage electrode, the method including operations of determining whether image data of a current frame is changed, compared to image data of a previous frame, when the image data of the current frame is changed, storing a voltage level corresponding to the image data of the current frame in the storage capacitor of each of the plurality of pixels, and when the image data of the current frame is not changed, changing a level of a second common voltage applied to the second common voltage electrode of each of the plurality of pixels.

When the image data of the current frame is not changed, the image data of the current frame may not be written to the pixel electrode of each of the plurality of pixels.

The operation of changing the level of a second common voltage may be performed to compensate for a voltage drop of the pixel electrode of each of the plurality of pixels.

Each of the plurality of pixels may include a liquid crystal cell connected between the pixel electrode and a first common voltage electrode.

When the image data of the current frame is changed, the method may further include an operation of inverting a polarity of a voltage applied to the liquid crystal cell.

When a reference time elapses after the voltage level is stored in the storage capacitor of each of the plurality of pixels, the method may further include an operation of storing the voltage level corresponding to the image data of the current frame in the pixel electrode of each of the plurality of pixels.

The method may further include an operation of measuring a voltage level of the pixel electrode of each of the plurality of pixels, and when a difference between the voltage level of the pixel electrode and the voltage level corresponding to the image data of the current frame is equal to or greater than a reference value, the operation of changing the level of a second common voltage may include an operation of compensating for a voltage drop of the pixel electrode by changing the level of the second common voltage by the difference.

The operation of changing the level may include an operation of changing the level of the second common voltage by a set voltage value at regular intervals.

The display apparatus may be an electrophoretic image display apparatus, an organic electroluminescent display apparatus, or a liquid crystal display apparatus.

According to another aspect of the example embodiments, there is provided a display apparatus including a pixel unit including a plurality of pixels, a common voltage driving unit that supplies a second common voltage to the plurality of pixels, and a compensation control unit, wherein each of the plurality of pixels stores a voltage level corresponding to a data signal and includes a storage capacitor connected between a pixel electrode and a second common voltage electrode, the compensation control unit determines whether image data of a current frame is changed, compared to image data of a previous frame, and when the image data of the current frame is changed, the compensation control unit controls the common voltage driving unit to store a voltage level corresponding to the image data of the current frame in the storage capacitor of each of the plurality of pixels, and when the image data of the current frame is not changed, the compensation control unit controls the common voltage driving unit to change a level of a second common voltage applied to the second common voltage electrode of each of the plurality of pixels.

When the image data of the current frame is not changed, the compensation control unit may control the image data of the current frame not to be written to the pixel electrode of each of the plurality of pixels.

When the image data of the current frame is not changed, the compensation control unit may control the level of the second common voltage to be changed to compensate for a voltage drop of the pixel electrode of each of the plurality of pixels.

Each of the plurality of pixels may further include a liquid crystal cell connected between the pixel electrode and a first common voltage electrode, and a first transistor including a gate electrode connected to a gate line for delivering a scan signal, a first electrode connected to a data line for delivering a data signal, and a second electrode connected to the pixel electrode.

When the image data of the current frame is changed, the compensation control unit may control a polarity of a voltage to be inverted, wherein the voltage is applied to the liquid crystal cell.

When a reference time elapses after the voltage level is stored in the storage capacitor of each of the plurality of pixels, the compensation control unit may control the voltage level corresponding to the image data of the current frame to be stored in the pixel electrode of each of the plurality of pixels.

The display apparatus may further include a voltage measuring unit that measures a voltage level of the pixel electrode of each of the plurality of pixels, and when a difference between the voltage level of the pixel electrode and the voltage level corresponding to the image data of the current frame is equal to or greater than a reference value, the compensation control unit may control a voltage drop of the pixel electrode to be compensated for by changing the level of the second common voltage by the difference.

When the level of the second common voltage is changed, the compensation control unit may control the level of the second common voltage to be changed by a set voltage value at regular intervals.

The display apparatus may be an electrophoretic image display apparatus, an organic electroluminescent display apparatus, or a liquid crystal display apparatus.

The display apparatus may further include a scan driving unit that outputs a scan signal to each of the plurality of pixels, a data driving unit that outputs a data signal to each of the plurality of pixels, and a timing control unit that controls the scan driving unit and the data driving unit.

BRIEF DESCRIPTION OF THE DRAWINGS

The above and other features and advantages will become more apparent by describing in detail exemplary embodiments thereof with reference to the attached drawings, in which.

DETAILED DESCRIPTION

The following description and drawings are provided to give a sufficient understanding of the example embodiments, and functions or constructions that are well-known to one of ordinary skill in the art may be omitted. Example embodiments may be embodied in many different forms and should not be construed as being limited to the embodiments set forth herein; rather, the spirit and scope of the example embodiments are defined by the claims. Also, terms or words used in the following description should be construed as fully satisfying the concept of the invention.

Example embodiments will now be described more fully with reference to the accompanying drawings.

Figure 1:
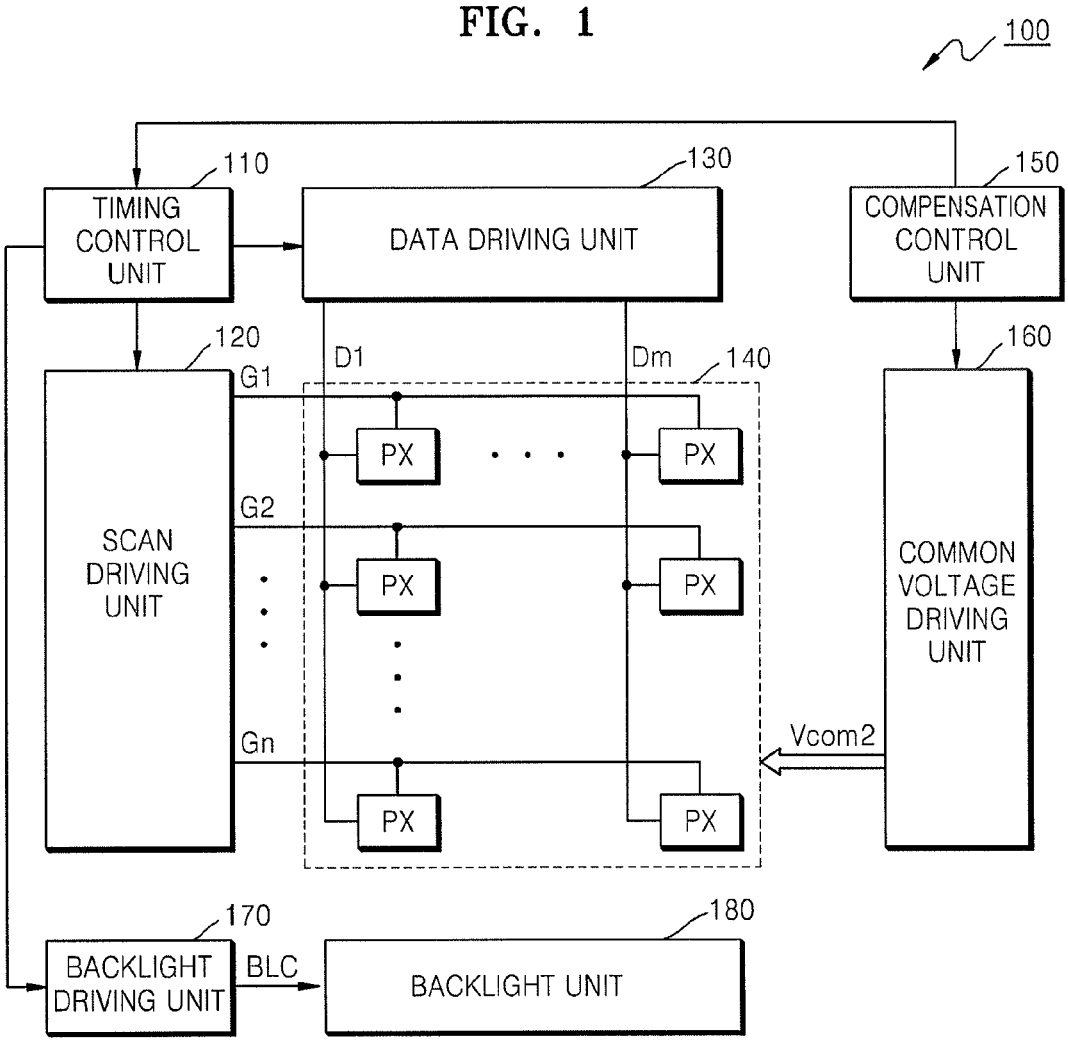
FIG. 1 is a diagram illustrating a structure of a display apparatus according to an embodiment.

FIG. 1 is a diagram illustrating a structure of a display apparatus 100 according to an embodiment. FIG. 1 illustrates a structure and operations of a liquid crystal display (LCD) apparatus as an example of the display apparatus 100 of FIG. 1. However, embodiments are not limited to the LCD apparatus. For example, the display apparatus 100 may be formed as an organic electroluminescent display, an electrophoretic display device, or the like.

The display apparatus 100 may include a timing control unit 110, a scan driving unit 120, a data driving unit 130, a pixel unit 140, a compensation control unit 150, a common voltage driving unit 160, a backlight driving unit 170, and a backlight unit 180.

The timing control unit 110 receives image data, receives a data enable signal, a vertical synchronization signal, a horizontal synchronization signal, and a clock signal from an external device (not shown) or a control block (not shown), and then generates an image data signal, a data driving control signal, and a gate driving control signal.

The timing control unit 110 receives input control signals such as the vertical synchronization signal, the clock signal, the data enable signal, or the like and then outputs the data driving control signal. Here, the data driving control signal may be a signal used to control an operation of the data driving unit 130 and may include a source shift clock, a source start pulse, a polarity control signal, a source output enable signal, and the like. Also, the timing control unit 110 receives the vertical synchronization signal and the clock signal and then outputs the gate driving control signal. The gate driving control signal may be a signal used to control an operation of the scan driving unit 120 and may include a gate start pulse, a gate output enable signal, or the like.

The scan driving unit 120 generates gate signals sequentially having scan pulses according to an order of columns, in response to the gate driving control signal supplied from the timing control unit 110, and supplies the gate signals to gate lines G1 through Gn. Here, the scan driving unit 120 determines a voltage level of each scan pulse, according to a gate high voltage and a gate low voltage that are generated by and provided from a direct current (DC)/DC converter (not shown) or the like. The voltage level of each scan pulse may vary according to a type of a switching device arranged in a pixel PX. That is, when the switching device is formed as an n-type transistor, the scan pulse has the gate high voltage in a period in which the scan pulse is activated, and when the switching device is formed as a p-type transistor, the scan pulse has the gate low voltage in a period in which the scan pulse is activated.

The data driving unit 130 supplies data signals to data lines D1 through Dm, in response to the image data signal and the data driving control signal that are supplied from the timing control unit 110. In more detail, the data driving unit 130 latches the image data signal by performing sampling on the image data signal supplied from the timing control unit 110, and converts the image data signal into an analog data signal by using a gamma voltage supplied from a gamma voltage generating circuit (not shown), wherein the analog data signal may express a grayscale of pixels PX of the pixel unit 140.

The pixel unit 140 includes the pixels PX near cross points of the gate lines G1 through Gn and the data lines D1 through Dm. Each pixel PX is connected to at least one data line Di and at least one gate line Gj (refer to FIG. 2). The gate lines G1 through Gn are disposed parallel to each other in a column direction, and the data lines D1 through Dm are disposed parallel to each other in a row direction. However, the gate lines G1 through Gn may extend in the row direction and the data lines D1 through Dm may extend in the column direction. A structure of each pixel PX will be described below with reference to FIG. 2.

Figure 2:
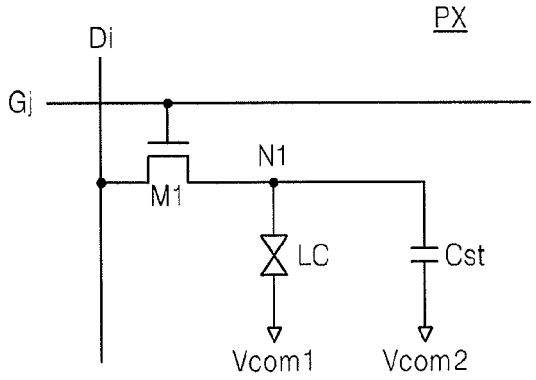
FIG. 2 is a diagram illustrating a structure of each pixel, according to an embodiment.

FIG. 2 is a diagram illustrating the structure of each pixel PX, according to an embodiment.

The pixel PX includes a first transistor M1, a liquid crystal cell LC, and a storage capacitor Cst. The first transistor M1 includes a gate electrode connected to a gate line Gj, a first electrode connected to a data line Di, and a second electrode connected to a first node N1. The first transistor M1 may function as a switching device and may be formed as a thin film transistor (TFT). The first node N1 is electrically equivalent to a pixel electrode. The liquid crystal cell LC is arranged between the first node N1 and a first common voltage electrode Vcom1. A first common voltage is applied to the first common voltage electrode Vcom1. The liquid crystal cell LC equivalently indicates liquid crystal molecules disposed between a pixel electrode and the first common voltage electrode Vcom1.

The storage capacitor Cst is connected between the first node N1 and a second common voltage electrode Vcom2. A second common voltage is applied to the second common voltage electrode Vcom2.

When a scan pulse is input to the gate line Gj, the first transistor M1 is turned on, so that a data signal that is input via the data line Di is applied to the first node N1. Due to the data signal, a voltage level corresponding to the data signal is stored in the storage capacitor Cst. An alignment of the liquid crystal molecules of the liquid crystal cell LC is changed according to a voltage of the first node N1, so that transmittance of the liquid crystal cell LC is changed.

The common voltage driving unit 160 generates voltage of the first common voltage electrode Vcom1 and the second common voltage electrode Vcom2, and applies them to each pixel PX. The voltage of the first common voltage electrode Vcom1 is applied to a terminal of the liquid crystal cell LC, and the voltage of the second common voltage electrode Vcom2 is applied to a terminal of the storage capacitor Cst. Configurations of the first common voltage electrode Vcom1 and the second common voltage electrode Vcom2 may vary according to an inversion driving method of the display apparatus 100.

When the display apparatus 100 uses a frame inversion driving method, the first common voltage electrode Vcom1 may be commonly connected to the pixels PX, and the second common voltage electrode Vcom2 may also be commonly connected to the pixels PX. In this case, the common voltage driving unit 160 generates and outputs one first common voltage and one second common voltage.

When the display apparatus 100 uses a line inversion method or a dot inversion method, the first common voltage electrode Vcom1 and the second common voltage electrode Vcom2 may be commonly connected between some of the pixels PX which have the same polarity. That is, in a case of the line inversion method, the first common voltage electrode Vcom1 and the second common voltage electrode Vcom2 may be commonly connected to the pixels PX in an alternate manner in columns or rows. When the dot inversion method is used, the first common voltage electrode Vcom1 and the second common voltage electrode Vcom2 may be commonly connected to the pixels PX in an alternate manner in dots. In this case, the common voltage driving unit 160 generates and outputs two first common voltages having different levels and two second common voltages having different levels.

The compensation control unit 150 determines whether image data of a current frame is changed, compared to image data of a previous frame. When the image data of the current frame is changed, the compensation control unit 150 stores a voltage level corresponding to the image data of the current frame in the storage capacitor Cst of each pixel PX. When the image data of the current frame is not changed, the compensation control unit 150 controls the timing control unit 110 and the common voltage driving unit 160 to change a level of the second common voltage that is applied to the second common voltage electrode Vcom2 of each pixel PX. Detailed operations of the compensation control unit 150 are described below.

The backlight unit 180 is disposed in a rear side of the pixel unit 140, is turned on, in response to a backlight driving signal BLC supplied from the backlight driving unit 170, and then emits light to the pixels PX of the pixel unit 140. According to a control by the timing control unit 110, the backlight driving unit 170 generates the backlight driving signal BLC, outputs the backlight driving signal BLC to the backlight unit 180, and controls emission of the backlight unit 180.

Figure 3:
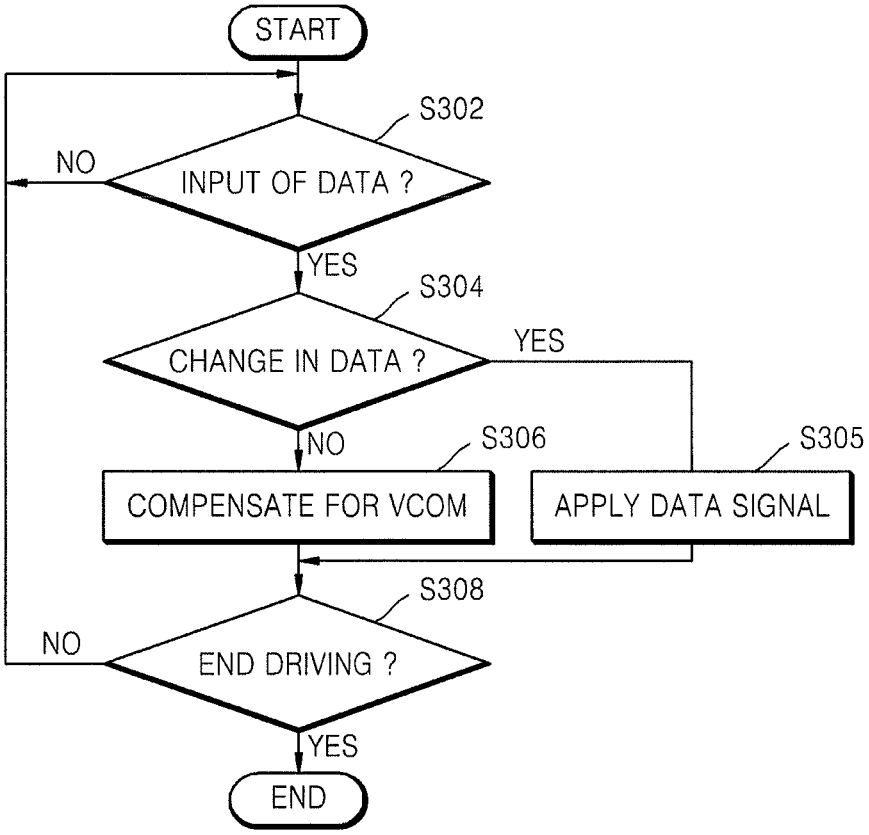
FIG. 3 is a flowchart illustrating a method of controlling a display apparatus, according to an embodiment.

FIG. 3 is a flowchart illustrating a method of controlling the display apparatus 100, according to an embodiment.

According to the method of the present embodiment, when a frame is changed, i.e., when it is determined that image data is input (operation S302), it is determined whether image data of a current frame is changed, compared to image data of a previous frame (operation S304).

When the image data of the current frame is changed, the compensation control unit 150 controls the timing control unit 110 to apply a data signal to a pixel electrode of each pixel PX and then to store a voltage level corresponding to the data signal in the storage capacitor Cst (operation S305). In this case, the timing control unit 110 controls the scan driving unit 120 and the data driving unit 130, so that the data driving unit 130 generates the data signal corresponding to the input image data and then outputs the data signal to each pixel PX, and the scan driving unit 120 scans the pixels PX in units of columns and then stores the voltage level corresponding to the data signal in the storage capacitor Cst of each pixel PX.

When the image data of the current frame is not changed, the compensation control unit 150 controls the common voltage driving unit 160 to compensate for a voltage drop of the pixel electrode by changing a second common voltage (operation S306). In this case, although the frame is changed, the scan driving unit 120 and the data driving unit 130 do not write the data signal to the pixels PX.

In detail, although the first transistor M1 of each pixel PX is in a turn-off state, a leakage current may occur via the first transistor M1, e.g., it may be difficult to completely remove the leakage current of the first transistor M1, thereby causing a potential drop of a voltage level of the pixel electrode. However, according to the present embodiment, when the image data is not changed although the frame is changed, a level of the second common voltage applied to the storage capacitor Cst of each pixel PX is changed, e.g., adjusted to compensate for the potential voltage drop triggered by a leakage current. Therefore, it is possible to prevent image deterioration due to a voltage drop of the pixel electrode.

Further, as the image data is not changed although a frame is changed, and a data signal is not written to the pixels PX, the power consumption due to driving of the data signal may be saved. Therefore, according to the one or more embodiments, it is possible to simultaneously decrease power consumption of the display apparatus 100 and to prevent image deterioration due to voltage drop of the pixel electrode.

The compensation control unit 150 changes the second common voltage as follows. The voltage drop of the pixel electrode of each pixel PX is measured, and then the second common voltage is changed, e.g., according to the measured voltage drop or according to a predetermined level at regular periods. When the second common voltage is changed, voltages of the pixel electrodes of the pixels PX are boosted via the storage capacitors Cst, so that the voltage drop is compensated for.

Operations S302, S304, S305, and S306 of FIG. 3 are repeated until driving of the display apparatus 100 is ended, i.e., an input of image data is ended (operation S308).

Figure 4:
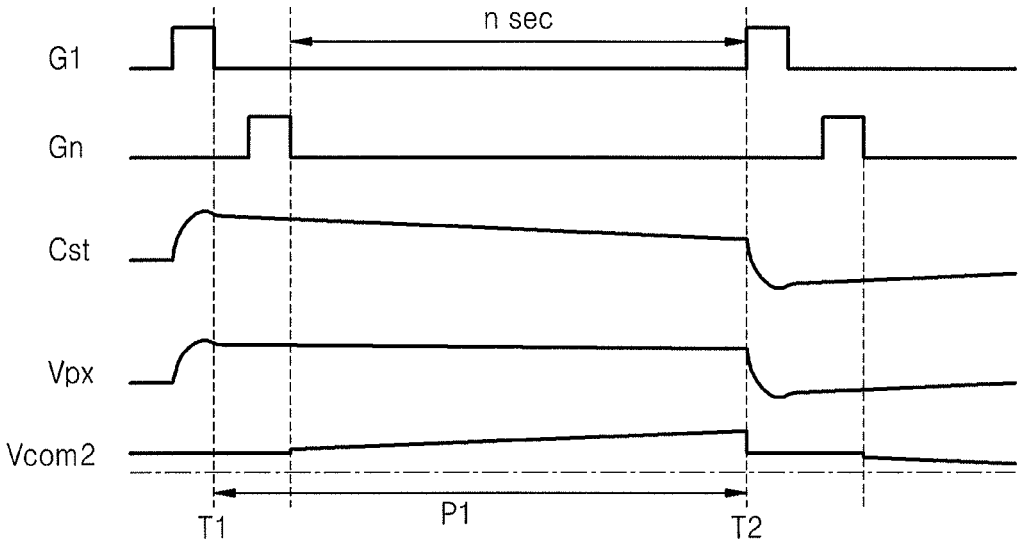
FIG. 4 is a timing diagram illustrating a method of driving the display apparatus, according to an embodiment.

FIG. 4 is a timing diagram illustrating a method of driving the display apparatus 100, according to an embodiment. Here, G1 indicates a signal level of a gate line G1 at a first column, Gn indicates a signal level of a gate line Gn at an nth column, Cst indicates a voltage level of a storage capacitor of a pixel from among a plurality of pixels at a first column, Vpx indicates a voltage level of a pixel electrode of the pixel at the first column, and Vcom2 indicates a voltage level of a second common voltage electrode of the pixel at the first column. Hereinafter, for convenience of description, the pixel at the first column is referred to as "first pixel".

According to the present embodiment, after a time T1 at which a data signal is applied to the first pixel, a voltage level of a second driving voltage may be increased in order to maintain the voltage level Vpx of the pixel electrode constant. In detail, referring to FIG. 4, the voltage level of the storage capacitor Cst of the first pixel is slowly decreased after time T1 due to a leakage current. Even thought the voltage applied to both terminals of the storage capacitor Cst is decreased, the second driving voltage is slowly, e.g., gradually, increased, thereby boosting the voltage level Vpx of the pixel electrode via the storage capacitor Cst. Therefore, the voltage level Vpx of the pixel electrode is maintained at a constant level between times T1 and T2.

Time T2 of FIG. 4 indicates a point at which image data is changed, so a data signal is applied to the pixel electrode. Thus, according to the present embodiment, the voltage level Vpx of the pixel electrode may be maintained constant in a period P1, i.e., between the time T1 and the time T2, in which image data is not changed.

In the embodiment of FIG. 4, the voltage level Vcom2 of the second common voltage electrode keeps increasing in the period P1, but the voltage level Vcom2 of the second common voltage electrode may not be continually increased. For example, a second common voltage may be increased stepwise.

Figure 5:
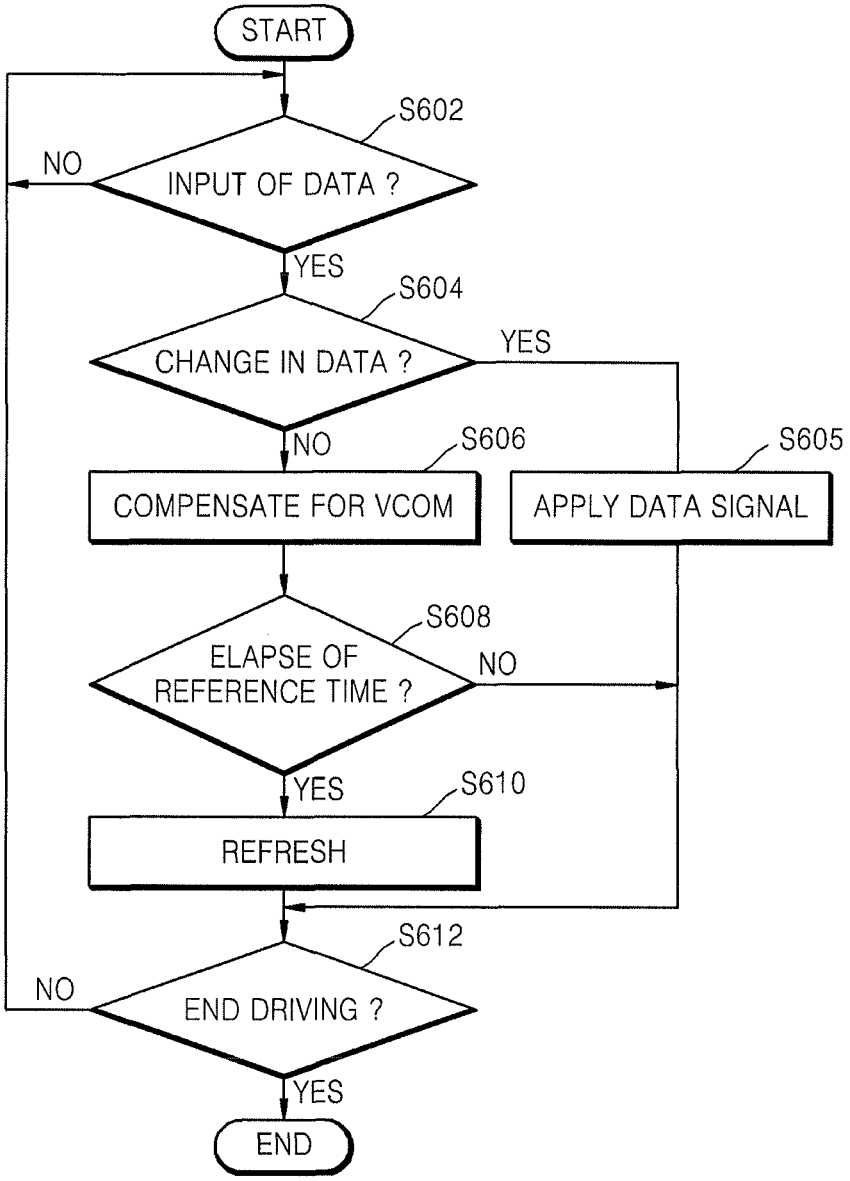
FIG. 5 is a flowchart illustrating a method of driving the display apparatus, according to another embodiment.

FIG. 5 is a flowchart illustrating a method of driving the display apparatus 100, according to another embodiment. According to the present embodiment, while image data is not changed, a voltage of a pixel electrode is written again at regular periods.

According to the method of the present embodiment, when a frame is changed and thus image data is input (operation S602), it is determined whether image data of a current frame is changed, compared to image data of a previous frame (operation S604).

When the image data of the current frame is changed, the compensation control unit 150 controls the timing control unit 110 to apply a data signal to the pixel electrode of each pixel PX and then to store the voltage level corresponding to the data signal in the storage capacitor Cst (operation S605).

Otherwise, when the image data of the current frame is not changed, the compensation control unit 150 controls the common voltage driving unit 160 to compensate for a voltage drop of the pixel electrode by changing the second common voltage (operation S606). In this case, although the frame is changed, the scan driving unit 120 and the data driving unit 130 do not write the data signal to the pixels PX.

Also, according to the method of the present embodiment, it is determined whether a reference time elapses from a time at which the data signal is written to the pixels PX (operation S608). The time at which the data signal is written may be a time at which the data signal is applied to the pixels of a first column, a time at which the data signal is completely written to all of the pixels PX, or a predetermined reference time after detection of a change in image data. In order to determine whether the reference time elapses from the time at which the data signal is written to the pixels PX, a timer (not shown) to count a time from a point at which the data signal is written may be used.

When the reference time elapses from the time at which the data signal is written to the pixels PX, a data signal corresponding to current image data is applied to the pixels PX and then voltage levels of the pixels PX are refreshed (operation S610).

Operations S602, S604, S605, S606, S608, and S610 are repeated until driving of the display apparatus 100 is ended, i.e., an input of image data is ended (operation S612).

According to the present embodiment, by compensating for a voltage level of a pixel electrode by using the second common voltage, it is possible to prevent distortion of an image displayed by the display apparatus 100.

For example, the reference time may an integer multiple of a horizontal period of the display apparatus 100. In another example, the reference time may be a time at which the storage capacitor Cst is completely discharged to a level of a second common voltage by a leakage current, when a data signal corresponding to a minimum grayscale of the display apparatus 100 is stored in the storage capacitor Cst. In this case, the reference time may be determined, in consideration of a change in the second common voltage.

Figure 6:
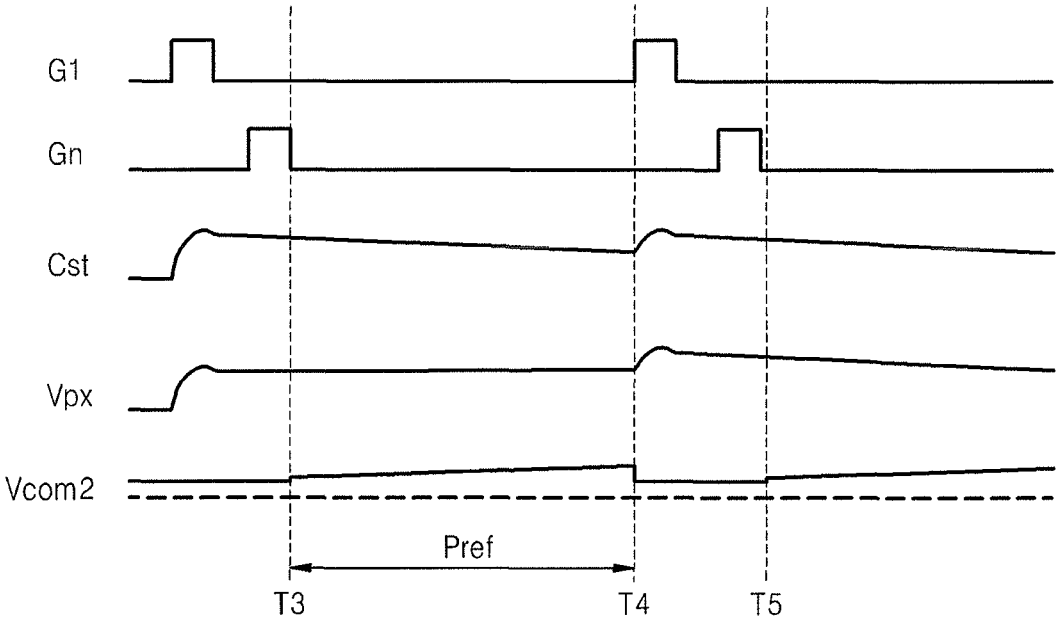
FIG. 6 is a timing diagram illustrating a method of driving the display apparatus, according to another embodiment.

FIG. 6 is a timing diagram illustrating a method of driving the display apparatus 100 according to the flow chart of FIG. 5.

As described above with reference to FIG. 5, according to the present embodiment, when image data is not changed, a voltage level of a pixel electrode of each pixel PX is refreshed at regular reference times. For example, as illustrated in FIG. 6, when a data signal is applied to the pixels PX at a time T3 and a data signal is not applied again to the pixels PX because image data is not changed until a reference time Pref elapses, a data signal corresponding to current image data is applied to a pixel electrode of the first pixel at a time T4 after the reference time Pref elapses from the time T3 at which the data signal has been applied. Here, the second common voltage Vcom2 is slowly increased or decreased during the reference time Pref, i.e., between time T3 and time T4, and then is changed to an initial level at time T4. Here, the initial level may indicate a level of the second common voltage Vcom2 before the second common voltage Vcom2 is changed, i.e., a level before the time T3.

Afterward, when a change in the image data is detected at a time T5, a data signal corresponding to the input image data is applied to the pixel electrodes of the pixels PX.

Figure 7:
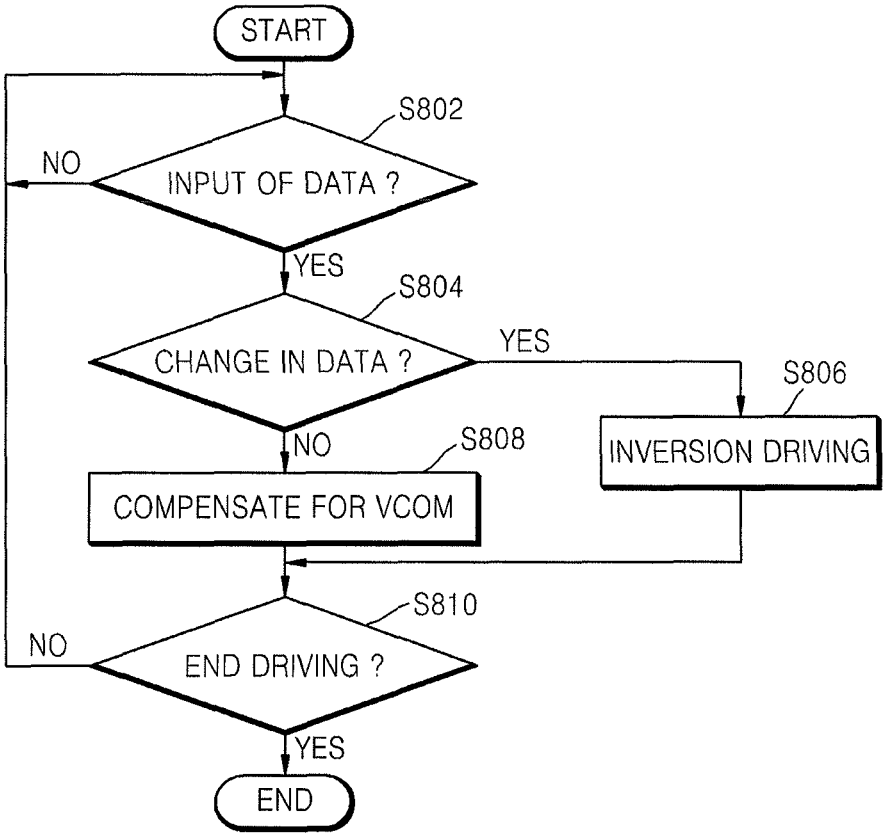
FIG. 7 is a flowchart illustrating a method of driving the display apparatus, according to another embodiment.

FIG. 7 is a flowchart illustrating a method of driving the display apparatus 100, according to another embodiment. According to the present embodiment, the method uses an inversion driving method and performs inversion driving only when image data is changed when a frame is changed, and when the image data is not changed, the method does not perform the inversion driving.

According to the method of the present embodiment, when a frame is changed and thus image data is input (operation S802), it is determined whether image data of a current frame is changed, compared to image data of a previous frame (operation S804).

When the image data of the current frame is changed, the compensation control unit 150 controls the timing control unit 110 to apply a data signal to a pixel electrode of each pixel PX and then to store a voltage level corresponding to the data signal in the storage capacitor Cst. Here, the inversion driving is performed so that a polarity of a voltage applied to the storage capacitor Cst and the liquid crystal cell LC is inverted (operation S806). The inversion driving according to the present embodiment may be one of a frame inversion technique, a column inversion technique, a row inversion technique, and a dot inversion technique.

Figure 8:
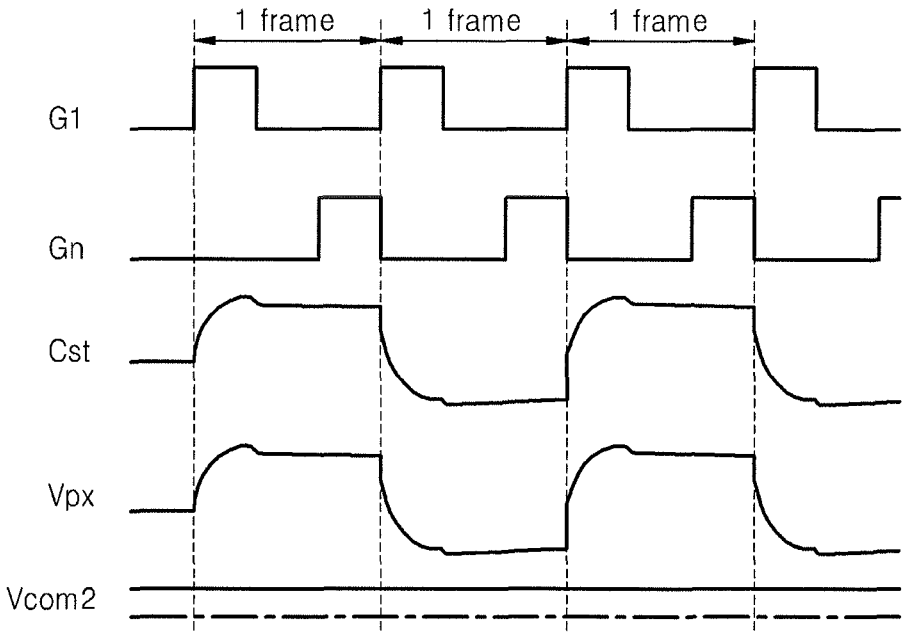
FIG. 8 is a timing diagram illustrating an inversion driving method, according to another embodiment.

FIG. 8 is a timing diagram illustrating the inversion driving method described with reference to FIG. 7.

As illustrated in FIG. 8, in the inversion driving method, a polarity of a voltage applied to the storage capacitor Cst and the liquid crystal cell LC is inverted whenever a frame is changed. FIG. 8 illustrates an example in which image data is changed whenever a frame is changed. According to the present embodiment, when image data is not changed although a frame is changed, as described above, a data signal is not applied to the pixel electrode, and the second common voltage Vcom2 is changed, so that a voltage drop of the pixel electrode is compensated for.

In the inversion driving method, a change of the second common voltage Vcom2, which is performed to compensate for the voltage drop of the pixel electrode, varies according to a polarity of a voltage that is applied to the storage capacitor Cst and the liquid crystal cell LC in a current frame. When a voltage with a negative polarity with respect to the second common voltage Vcom2 is applied to the pixel electrode, the second common voltage Vcom2 is decreased to compensate for the voltage drop of the pixel electrode. When a voltage with a positive polarity with respect to the second common voltage Vcom2 is applied to the pixel electrode, the second common voltage Vcom2 is increased to compensate for the voltage drop of the pixel electrode.

Referring back to FIG. 7, when the image data is not changed, the compensation control unit 150 controls the common voltage driving unit 160 to compensate for the voltage drop of the pixel electrode by changing the second common voltage (operation S808). In this case, although the frame is changed, the scan driving unit 120 and the data driving unit 130 do not write the data signal to the pixels PX.

Operations S802, S804, S806, and S808 are repeated until driving of the display apparatus 100 is ended, i.e., an input of image data is ended (operation S810).

Figure 9:
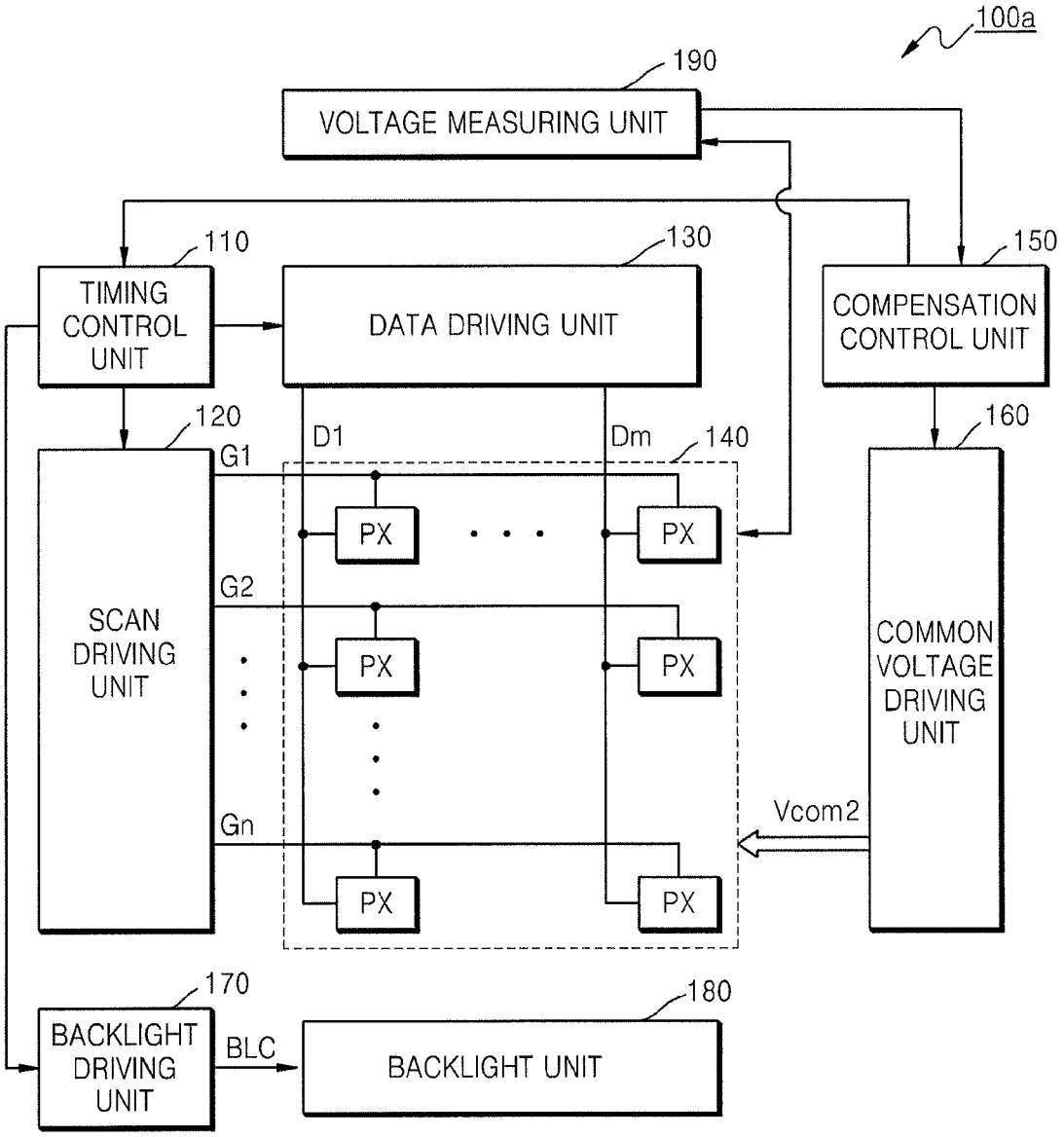
FIG. 9 is a diagram illustrating a structure of a display apparatus according to another embodiment.

FIG. 9 is a diagram illustrating a structure of a display apparatus 100*a* according to another embodiment. Referring to FIG. 9, the display apparatus 100*a* may include the timing control unit 110, the scan driving unit 120, the data driving unit 130, the pixel unit 140, the compensation control unit 150, the common voltage driving unit 160, the backlight driving unit 170, the backlight unit 180, and a voltage measuring unit 190.

According to the present embodiment, when image data is not changed although a frame is changed, the compensation control unit 150 measures a voltage of a pixel electrode of each pixel PX, and when a voltage drop equal to or greater than a reference value occurs in the pixel electrode, the compensation control unit 150 compensates for the voltage drop of the pixel electrode by changing a level of the second common voltage Vcom2 by an amount of the voltage drop. To do so, the voltage measuring unit 190 may measure a voltage of the pixel electrodes of some or all of the pixels PX.

According to the one or more embodiments, the voltage drop of the pixel electrode is compensated for by an actual amount of the voltage drop, so that the voltage drop of the pixel electrode may be further accurately compensated for. Also, according to the one or more embodiments, it is possible to decrease power consumption to drive a data signal, and to prevent image deterioration due to a leakage current from the storage capacitor.

While example embodiments have been particularly shown and described, it will be understood by those of ordinary skill in the art that various changes in form and details may be made therein without departing from the spirit and scope of the present invention as defined by the following claims.

What is claimed is:

1. A method of driving a display apparatus having a plurality of pixels, each pixel including a liquid crystal cell connected between a pixel electrode and a first common voltage electrode and a storage capacitor connected between the pixel electrode and a second common voltage electrode, the method comprising:

determining whether image data of a current frame is changed, as compared to image data of a previous frame;

when the image data of the current frame is changed, storing a voltage level corresponding to the image data of the current frame in the storage capacitor of each of the plurality of pixels;

when the image data of the current frame is not changed, changing a level of a second common voltage applied to the second common voltage electrode of each of the plurality of pixels; and when a reference time elapses after the voltage level is changed to the level of the second common voltage applied to the second common voltage electrode of each of the plurality of pixels, changing the level of the second common voltage to a level before the second common voltage is changed.

2. The method of claim 1, wherein, when the image data of the current frame is not changed, the image data of the current frame is not written to the pixel electrode of each of the plurality of pixels.

3. The method of claim 1, wherein changing the level of the second common voltage is performed to compensate for a voltage drop of the pixel electrode of each of the plurality of pixels.

4. The method of claim 1, further comprising measuring a voltage level of the pixel electrode of each of the plurality of pixels, and when a difference between the voltage level of the pixel electrode and the voltage level corresponding to the image data of the current frame is equal to or greater than a reference value, changing the level of the second common voltage includes compensating for a voltage drop of the pixel electrode by changing the level of the second common voltage by the difference.

5. The method of claim 1, wherein changing the level of the second common voltage includes changing the level of the second common voltage by a set voltage value at regular intervals.

6. The method of claim 1, wherein the display apparatus is an electrophoretic image display apparatus, an organic electroluminescent display apparatus, or a liquid crystal display apparatus.

7. A display apparatus, comprising:

a pixel unit including a plurality of pixels, each of the plurality of pixels including a liquid crystal cell connected between a pixel electrode and a first common voltage electrode and a storage capacitor connected between the pixel electrode and a second common voltage electrode;

a common voltage driver to supply a second common voltage to the plurality of pixels; and a compensation controller to determine whether image data of a current frame is changed, as compared to image data of a previous frame, wherein, when the image data of the current frame is changed, the compensation controller is to control the common voltage driver to store a voltage level corresponding to the image data of the current frame in the storage capacitor of each of the plurality of pixels, wherein, when the image data of the current frame is not changed, the compensation controller is to control the common voltage driver to change a level of the second common voltage applied to the second common voltage electrode of each of the plurality of pixels, and wherein, when a reference time elapses after the voltage level is changed to the level of the second common voltage applied to the second common voltage electrode of each of the plurality of pixels, the compensation controller is to control the common voltage driver to change the level of the second common voltage to a level before the second common voltage is changed.

8. The display apparatus of claim 7, wherein, when the image data of the current frame is not changed, the compensation controller is to control the image data of the current frame not to be written to the pixel electrode of each of the plurality of pixels.

9. The display apparatus of claim 7, wherein, when the image data of the current frame is not changed, the compensation controller is to control the level of the second common voltage to be changed to compensate for a voltage drop of the pixel electrode of each of the plurality of pixels.

10. The display apparatus of claim 7, wherein each of the plurality of pixels further comprises a first transistor having a gate electrode connected to a gate line for delivering a scan signal, a first electrode connected to a data line for delivering a data signal, and a second electrode connected to the pixel electrode.

11. The display apparatus of claim 7, further comprising:

a voltage detector to measure a voltage level of the pixel electrode of each of the plurality of pixels, and when a difference between the voltage level of the pixel electrode and the voltage level corresponding to the image data of the current frame is equal to or greater than a reference value, the compensation controller is to control a voltage drop of the pixel electrode to be compensated for by changing the level of the second common voltage by the difference.

12. The display apparatus of claim 7, wherein, when the level of the second common voltage is changed, the compensation controller is to control the level of the second common voltage to be changed by a set voltage value at regular intervals.

13. The display apparatus of claim 7, wherein the display apparatus is an electrophoretic image display apparatus, an organic electroluminescent display apparatus, or a liquid crystal display apparatus.

14. The display apparatus of claim 7, further comprising:

a scan driver to output a scan signal to each of the plurality of pixels;

a data driver to output a data signal to each of the plurality of pixels; and a timing controller to control the scan driver and the data driver.

15. The method of claim 1, further comprising, when the image data of the current frame is changed, inverting a polarity of a voltage applied to a liquid crystal cell.

16. The display apparatus of claim 7, wherein, when the image data of the current frame is changed, the compensation controller is to control a polarity of a voltage to be inverted, wherein the voltage is applied to the liquid crystal cell.

* * * * *